US011141987B2

(12) United States Patent
Parera Fiestas et al.

(10) Patent No.: US 11,141,987 B2
(45) Date of Patent: Oct. 12, 2021

(54) FLUID DELIVERING IN A PRINTER

(71) Applicant: HEWLETT-PACKARD DEVELOPMENT COMPANY, L.P., Houston, TX (US)

(72) Inventors: Oriol Parera Fiestas, Sant Cugat del Valles (ES); Tuomo Eljas Kaikkonen, Sant Cugat del Valles (ES); Albert Crespi Serrano, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 578 days.

(21) Appl. No.: 16/089,514

(22) PCT Filed: Mar. 28, 2017

(86) PCT No.: PCT/US2017/024583
§ 371 (c)(1),
(2) Date: Sep. 28, 2018

(87) PCT Pub. No.: WO2018/182581
PCT Pub. Date: Oct. 4, 2018

(65) Prior Publication Data

US 2021/0206174 A1 Jul. 8, 2021

(51) Int. Cl.
*B41J 2/175* (2006.01)
*B41J 29/393* (2006.01)

(52) U.S. Cl.
CPC ..... *B41J 2/17556* (2013.01); *B41J 2/1752* (2013.01); *B41J 2/17513* (2013.01);
(Continued)

(58) Field of Classification Search
CPC ..... B41J 2/175; B41J 2/17513; B41J 2002/17516; B41J 2/1752; B41J 2/17523;
(Continued)

(56) References Cited

U.S. PATENT DOCUMENTS 5,751,300 A 5/1998 Cowger et al.
6,290,343 B1 * 9/2001 Lewis ..... B41J 2/175 347/85

(Continued)

FOREIGN PATENT DOCUMENTS

EP 0945781 A2 9/1999
EP 2093065 A1 8/2009
WO 2017040423 A1 3/2017

OTHER PUBLICATIONS

Thomas, "The Development of the Toner Density Sensor for Closed-Loop Feedback Laser Printer Calibration", Retrieved from Internet: http://libres.uncg.edu/ir/uncc/f/Thomas_uncc_0694D_10011.pdf, 2009, 136 pages.

*Primary Examiner* — Anh T Vo
(74) *Attorney, Agent, or Firm* — HP Inc. Patent Department

(57) ABSTRACT

Operating a fluid delivering system in a printer, wherein the fluid delivering system comprises a fluid supply including a fluid bag which contains a fluid to be delivered to a fluid delivering tube connected to a printhead, and a closed pressurizing volume which surrounds the fluid bag to expel fluid from the fluid bag to the fluid delivering tube when applying pressure from a pressurizing system to the pressurizing volume, wherein pressure in the pressurizing system relative to atmosphere is measured by a first sensor, and wherein a second sensor provides an output signal which indicates a pressure difference between the pressurizing system and the fluid delivering tube, comprising disconnecting the pressurizing volume of the fluid supply from the pressurizing system, providing a connection of the pressurizing volume to atmosphere to transmit atmospheric pressure to the fluid, generating pressure in the pressurizing system, performing measurements of the pressure in the pressurizing system relative to atmosphere by the first
(Continued)

sensor, and calibrating the second sensor by the measurements of the first sensor.

15 Claims, 3 Drawing Sheets

(52) U.S. Cl.
CPC ..... *B41J 2/17523* (2013.01); *B41J 2/17566* (2013.01); *B41J 2/17596* (2013.01); *B41J 29/393* (2013.01); *B41J 2002/17516* (2013.01); *B41J 2002/17586* (2013.01)

(58) Field of Classification Search
CPC ..... B41J 2/17556; B41J 2/17566; B41J 2002/17586; B41J 2/17596; B41J 29/393
See application file for complete search history.

(56) References Cited

U.S. PATENT DOCUMENTS

| | | | | |
|---|---|---|---|---|
| 6,315,402 | B1 * | 11/2001 | Kawase | B41J 2/17513 347/85 |
| 6,431,679 | B1 | 8/2002 | Li et al. | |
| 6,685,290 | B1 | 2/2004 | Farr et al. | |
| 6,796,627 | B2 * | 9/2004 | Kimura | B41J 2/17509 347/7 |
| 7,059,701 | B2 | 6/2006 | Deer et al. | |
| 7,874,635 | B2 | 1/2011 | Kusaka | |
| 2006/0071985 | A1 | 4/2006 | Therien et al. | |
| 2016/0018281 | A1 | 1/2016 | Hammerschmidt | |

* cited by examiner

FLUID DELIVERING IN A PRINTER

BACKGROUND

In many kinds of printers printing includes delivering fluid from a fluid supply to a printhead. The fluid is ink or another fluid used in the printer. In some types of printers the fluid is contained in a fluid bag, wherein a closed pressurizing volume surrounds the fluid bag to expel fluid to the printhead when pressure is applied from a pressurizing system to the pressurizing volume. In some types of printers the printhead is part of a cartridge containing the fluid, in others the printhead is separate from a fluid supply. When printhead and fluid supply are separate, the printhead obtains fluid via a fluid delivering tube.

DETAILED DESCRIPTION

Figure 1A:
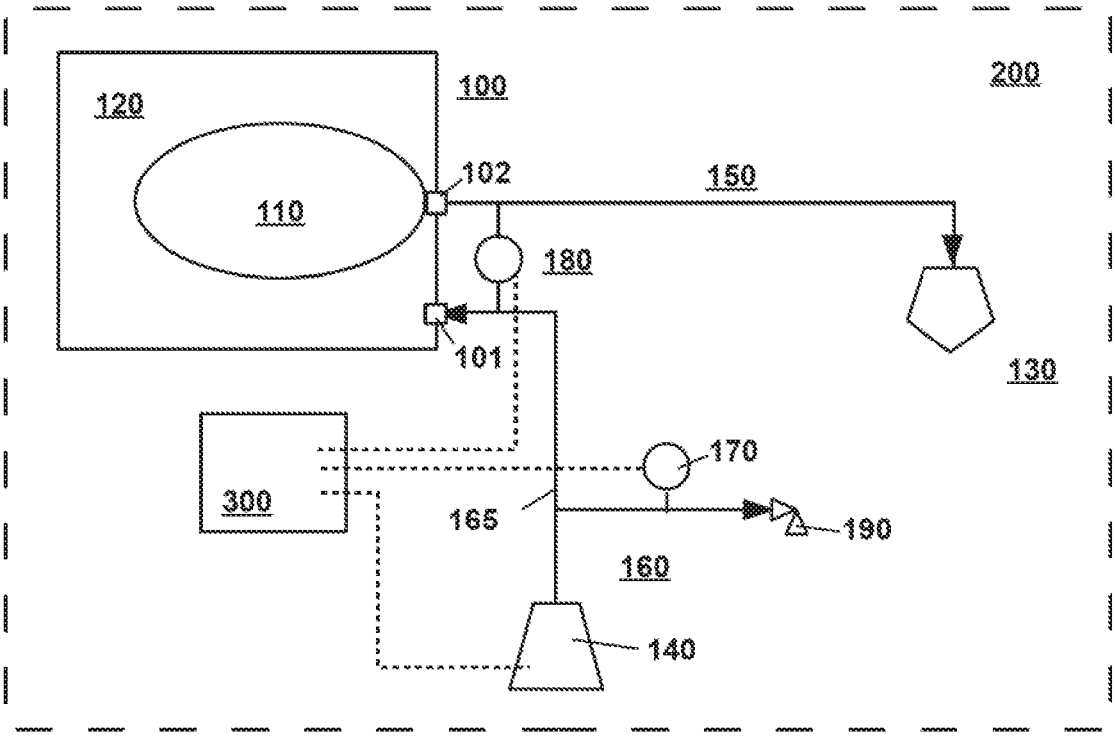
FIGS. 1*a*) and *b*) are schematic diagrams of an example fluid delivering system in a printer, which includes a fluid supply with a fluid bag containing a fluid to be delivered to a printhead, and a closed pressurizing volume surrounding the fluid bag to expel fluid to the printhead when applying pressure from a pressurizing system to the pressurizing volume, where two different example modes of operation are illustrated.

FIG. 1*a*) shows a schematic diagram of an example fluid delivering system in a printer 200. (Other components of the printer 200 are not shown in the figure.) The fluid delivering system includes a fluid supply 100 with a fluid bag 110 which contains a fluid to be delivered to a printhead 130 of the printer 200, and a closed pressurizing volume 120 which surrounds the fluid bag 110. The printhead 130 is connected to the fluid bag 110 of the fluid supply 100 by a fluid delivering tube 150.

When the fluid delivering system is in a printing mode, fluid is delivered from the interior of the fluid bag 110 to the printhead 130 via the fluid delivering tube 150 when pressure is applied to the pressurizing volume 120 of the fluid supply 100.

An example pressurizing system 160 to apply pressure to the pressurizing volume 120 is shown in FIG. 1*a*). The example pressurizing system 160 includes a pressurizing pump 140 and a tubing 165 by which connects the pressurizing pump 140 to the pressurizing volume 120 of the fluid supply 100. The tubing 165 connects further to a first pressure sensor 170 and to a pressure relief valve 190. In the example pressurizing system 160 the pressurizing pump 140 is a pump to feed air at a given pressure to the pressurizing volume 120 of the fluid supply 100. By the pressure applied to the fluid bag 110 fluid contained in the fluid bag 110 is expelled to the printing head 130 via the fluid delivering tube 150. Pressure in the pressurizing system 160 relative to atmosphere is measured by the first pressure sensor 170.

The fluid delivering system includes a second pressure sensor 180 which provides an output signal that indicates a pressure difference between the pressurizing system 160, more particularly, the tubing 165, and the fluid delivering tube 150.

A controller 300 of the fluid delivering system is connected to the first and second pressure sensors 170, 180 and to the pump 140 to control the pressure applied to the pressurizing volume 120 of the fluid supply 100.

The output signal of the second sensor 180 that indicates a pressure difference between the pressurizing system 160 and the fluid delivering tube 150 is used to check the amount of fluid remaining in the fluid bag 110 of the fluid supply 100 until reaching an empty state. When the output signal of the second sensor 180 is properly calibrated, the amount of fluid remaining in the fluid bag 110 of the fluid supply 100 can be detected very precisely by the pressure difference between the pressurizing system 160 and the fluid delivering tube 150. By reading pressures from the second sensor 180, printer 200 malfunction or damage in the printhead 130 can be avoided.

Figure 3:
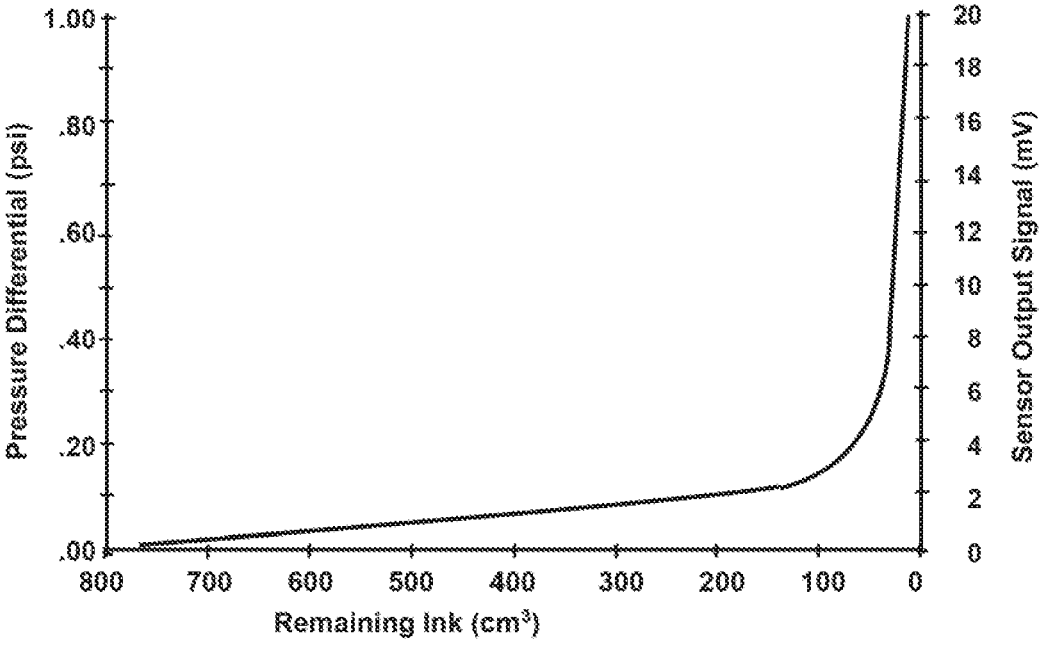
FIG. 3 is a diagram which shows a sensor output signal of a sensor in an example printer ink fluid delivering system as a function of a remaining amount of ink fluid in the fluid supply.

FIG. 3 is a diagram which shows a sensor output signal of the second sensor 180 in an example printer ink fluid delivering system as a function of a remaining amount of ink fluid in the fluid supply 100. The FIG. 3 shows an example of a working range of the second sensor 180 used to determine the remaining ink level present in the fluid supply 100 and an Out of Ink condition of the fluid supply 100.

When in the example the ink level inside the fluid bag 110 is over certain amount, the first sensor 170 measures the pressure in the tubing 165 of the pressurizing system 160 compared to atmosphere, and the second sensor 180 measures the difference between the tubing 165 and the fluid delivering tube 150. When, e.g. the fluid bag 110 is full the pressure difference as measured by the second sensor 180 is small, as can be seen on the left-hand side of FIG. 3. The second sensor 180 detects small pressure differences because, in the example, the hydrostatic pressure due to the ink height (from the ink level in the fluid bag 110 to the second sensor 180 position) is sufficient to deliver the ink fluid over tube 150 to the printhead 130. When printer 200 prints and uses ink volume, the hydrostatic pressure from the ink level in the fluid bag 110 to the second sensor 180 position slightly and continuously decreases. In order to set a constant pressure in the fluid delivering tube 150 to printhead 130, the pressure in the pressurizing system 160 and, therefore, the pressure difference as measured by the second sensor 180 slightly and continuously increases too. In other words, in that example, the increasing pressure by the pressurizing system 160 compensates for a decreasing hydrostatic pressure by the fluid in the fluid bag 110.

When the fluid bag 110 is almost empty of ink, so that increasing pressure in the pressurizing volume 120 is to expel the rest of ink from the fluid bag 110, the curve shown in FIG. 3 enters an exponential phase. That indicates the end of the ink in the supply 100. When difference is, for example, 1.00 PSI controller 300 decides that the ink supply 100 is empty.

Figure 1B:
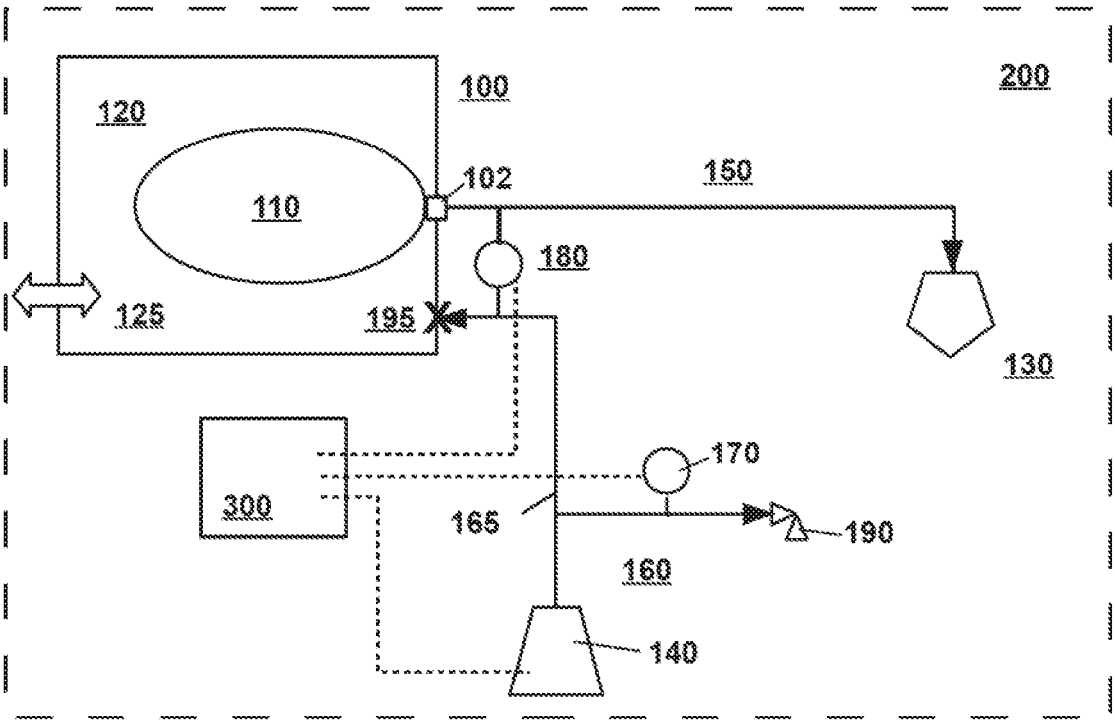

FIG. 1*b*) shows a schematic diagram of the fluid delivering system of FIG. 1*a*) in an example sensor calibration mode. Similar as in the normal operation mode, pressure in the pressurizing system 160 relative to atmosphere is measured by the first sensor 170, and the second sensor 180 provides an output signal which indicates a pressure difference between the pressurizing system 160 and the fluid delivering tube 150.

In general, to calibrate the second sensor 180 the pressurizing volume 120 of the fluid supply 100 is disconnected from the pressurizing system 160. A connection of the pressurizing volume 120 to atmosphere is established to transmit atmospheric pressure to the fluid in the fluid bag 120 and the fluid delivering tube 150, and pressure is generated in the pressurizing system 160.

Measurements of the pressure in the pressurizing system 160 relative to atmosphere by the first sensor 170 are taken and used to calibrate the second sensor 180.

Figure 2:
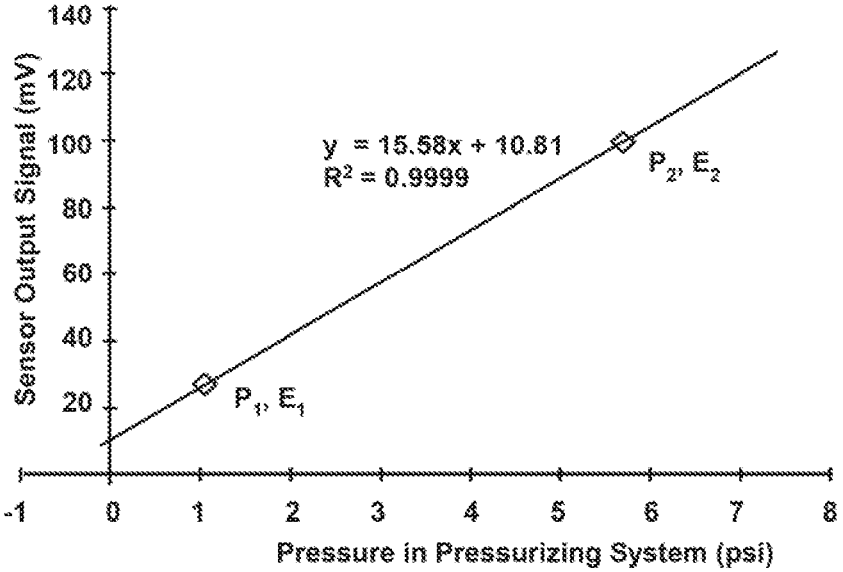
FIG. 2 is a diagram which shows a sensor output signal of a sensor in an example fluid delivering system as a function of pressure applied by the pressurizing system.

FIG. 2 is a diagram which shows a sensor output signal of the second sensor 180 in an example fluid delivering system as a function of pressure applied by the pressurizing system and measured by the first sensor 170.

As shown in the example of FIG. 2, first and second different pressure values $P_1$ and $P_2$ are generated in the pressurizing system 160, measured by the first sensor 170 and used to calibrate the second sensor 180. The calibration according to this example includes generating pressure in the pressurizing system at a first pressure $P_1$, taking at least one sample of the output signal $E_1$ of the second sensor 180 which corresponds to the measurement of the first sensor 170 at the first pressure $P_1$, generating pressure in the pressurizing system at a second pressure $P_2$, taking at least one sample of the output signal $E_2$ of the second sensor 180 which corresponds to the measurement of the first sensor 170 at the second pressure $P_2$, and calculating offset and gain of a linear function from the samples $E_1$, $E_2$ of the second sensor 180 and the measurements $P_1$, $P_2$ of the first sensor 170 to calibrate the second sensor 180.

In the example of FIG. 2 the linear function of the second sensor 180 output signal (in mV) as a function of the pressure in the pressurizing system 160 (in psi) is $y=15.58x+10.81$.

Referring back to FIGS. 1*a*) and *b*), in an example, the fluid supply 100 is a cartridge which includes the fluid bag 110 and the closed pressurizing volume 120 which surrounds the fluid bag 110. The fluid supply cartridge 100 has a first connecting element 101 to connect the pressurizing volume 120 to the pressurizing system 160, and a second connecting element 102 to connect the interior of the fluid bag 110 to the fluid delivering tube 150 which in turn is connected to the printhead 130. The cartridge 100 further includes a blocking element 195 which blocks the pressurizing volume 120 at the first connecting element from the pressurizing system 160, and a vent 125 which provides a connection of the pressurizing volume 120 to atmosphere.

According to one example the blocking element 195 is a blocking valve which is operable to connect and to disconnect the pressurizing volume 120 of the fluid supply cartridge 100 from the pressurizing system 160. Similar, in an example, the vent 125 is a venting valve which is operable to provide and to close a connection of the pressurizing volume 120 to atmosphere.

Figure 4:
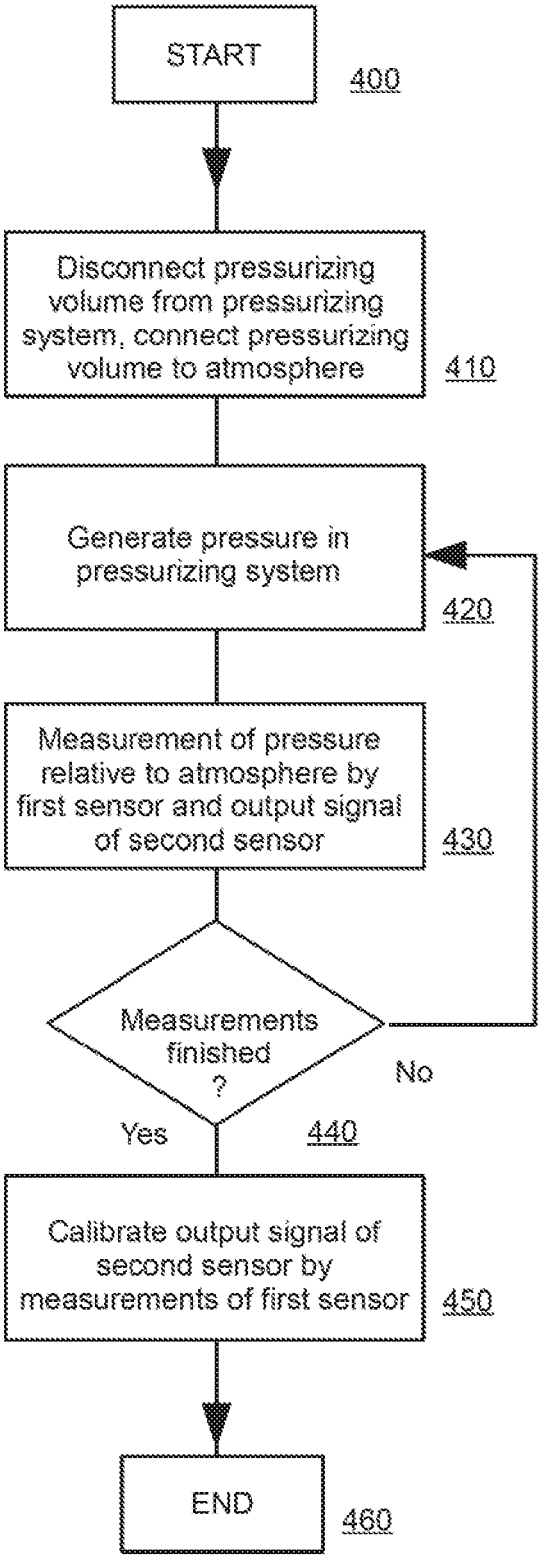
FIG. 4 is a block diagram of an example method of operating a fluid delivering system in a printer in a calibrating mode.

FIG. 4 is a block diagram of an example method of operating a fluid delivering system in a printer in a calibrating mode.

In the example calibrating mode the fluid delivering system includes a fluid supply 100 having a fluid bag 110 which contains a fluid to be delivered to a fluid delivering tube 150 connected to a printhead 130, and a closed pressurizing volume 120 which surrounds the fluid bag 110 to expel fluid to the fluid delivering tube 150 when applying pressure from the pressurizing system 160, as illustrated in FIG. 1.

The example method is started at 400. At 410 the pressurizing volume 120 of the fluid supply 100 is disconnected from the pressurizing system 160, and a connection of the pressurizing volume 120 to atmosphere is provided to transmit atmospheric pressure to the fluid in the pressurizing volume.

At 420 pressure in the pressurizing system 160 is generated. At 430 pressure in the pressurizing system relative to atmosphere is measured by the first sensor 170, and an output signal of second sensor 180 is provided which indicates a pressure difference between the pressurizing system 160 and the fluid delivering tube 150.

At 440 is decided whether enough measurements have been carried out to perform calibration of the second sensor 180. If No, return is to 420. If the decision at 440 is Yes, at 450 the output signal of the second sensor 180 is calibrated by the measurements of the first sensor 170, and the calibrating mode ends at 460.

Figure 5:
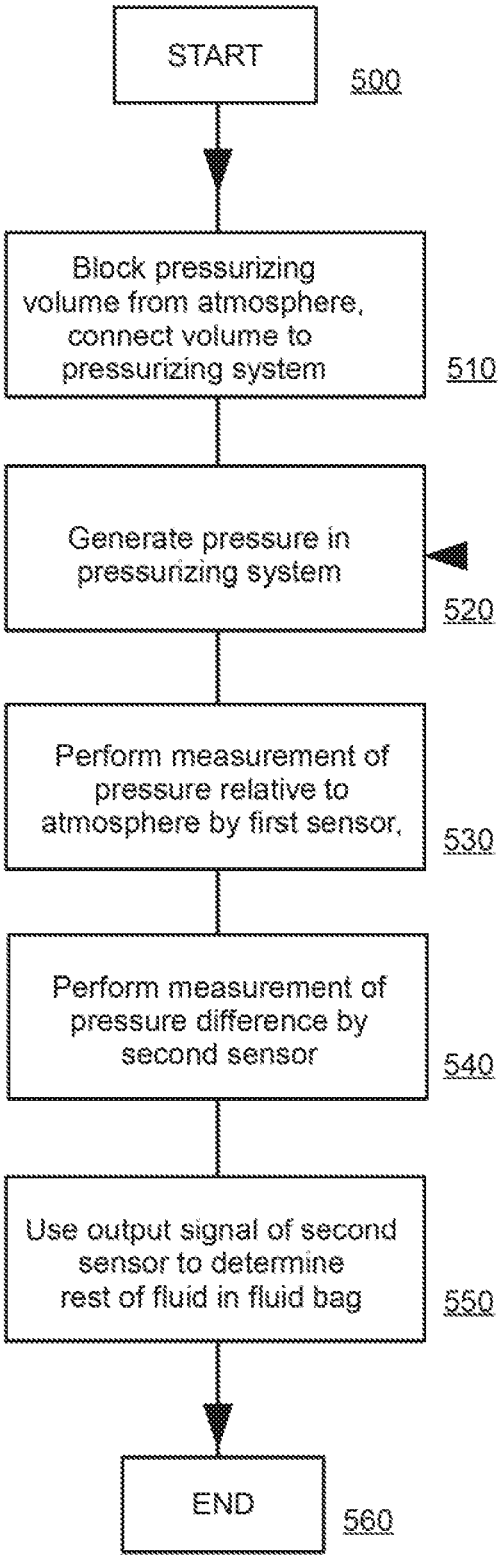
FIG. 5 is a block diagram of an example method of operating a fluid delivering system in a printer in a printing mode.

FIG. 5 is a block diagram of an example method of operating a fluid delivering system in a printer in a printing mode.

Start is at 500. In the example printing mode a connection of the pressurizing volume 120 of the fluid supply 100 to atmosphere is blocked, and the pressurizing volume 120 of the fluid supply 100 has a connection to the pressurizing system 160, as indicated at 510.

At 520 pressure in the pressurizing system 160 is generated at a given pressure to expel fluid from the fluid bag 110 over the fluid delivering tube 150 to the printhead 130.

At 530 measurement of pressure relative to atmosphere is measured by the first sensor 170. At 540 measurement of the pressure difference between the pressurizing system 160 and the fluid delivering tube 150 is measured by the second sensor 180.

At 550 the output signal of the second sensor 180 is used to determine a remaining amount of fluid in the fluid bag 110 of the fluid supply 100. The method ends at 560.

In an example, connecting the pressurizing volume 120 of the fluid supply 100 to atmosphere and disconnecting the pressurizing volume 120 of the fluid supply 100 from the pressurizing system 160 can be done by a specialized fluid supply cartridge 100 which has a blocking element 195 which blocks the pressurizing volume 120 from the pressurizing system 160, and a vent 125 which provides a connection of the pressurizing volume 120 to atmosphere. (in contrast, in a normal fluid supply 100 there is no connection of the pressurizing volume 120 to atmosphere, and the pressurizing volume 120 of the fluid supply 100 is not disconnected from the pressurizing system 160.)

In another example, the blocking element 195 is a blocking valve which is operable to optionally connect and disconnect the pressurizing volume 120 of the fluid supply cartridge 100 to and from the pressurizing system 160, and wherein the vent 125 includes a venting valve which is operable to optionally provide and close a connection of the pressurizing volume 120 to atmosphere.

What is claimed is:

1. A method of operating a fluid delivering system in a printer, wherein the fluid delivering system comprises a fluid supply including a fluid bag which contains a fluid to be delivered to a fluid delivering tube connected to a printhead, and a closed pressurizing volume which surrounds the fluid bag to expel fluid from the fluid bag to the fluid delivering tube when applying pressure from a pressurizing system to the pressurizing volume, wherein pressure in the pressurizing system relative to atmosphere is measured by a first sensor, and wherein a second sensor provides an output signal which indicates a pressure difference between the pressurizing system and the fluid delivering tube, comprising disconnecting the pressurizing volume of the fluid supply from the pressurizing system, providing a connection of the pressurizing volume to atmosphere to transmit atmospheric pressure to the fluid, generating pressure in the pressurizing system, performing measurements of the pressure in the pressurizing system relative to atmosphere by the first sensor, and calibrating the second sensor by the measurements of the first sensor.

2. The method of claim 1, wherein at least first and second different pressure values are generated in the pressurizing system and used to calibrate the second sensor.

3. The method of claim 1, comprising generating pressure in the pressurizing system at a first pressure ($P_1$), taking at least one sample of the output signal (E) of the second sensor which corresponds to a measurement (P) of the first sensor at the first pressure ($P_1$), generating pressure in the pressurizing system at a second pressure ($P_2$), taking at least one sample of the output signal (E) of the second sensor which corresponds to a measurement (P) of the first sensor at the second pressure ($P_2$), and calculating offset and gain of a linear function from the samples (E) of the second sensor and the measurements (P) of the first sensor at the first pressure ($P_1$) and at the second pressure ($P_2$) to calibrate the second sensor.

4. The method of claim 1, wherein air pressure is generated in the pressurizing system which is above atmospheric pressure.

5. The method of claim 1, comprising, in a printing mode, blocking the connection of the pressurizing volume of the fluid supply to atmosphere, connecting the pressurizing system to the pressurizing volume of the fluid supply, and generating pressure in the pressurizing system at a given pressure to expel fluid from the fluid bag over the fluid delivering tube to the printhead, wherein the output signal of the second sensor is used to determine a remaining amount of fluid in the fluid bag of the fluid supply.

6. The method of claim 1, comprising, in a printing mode, blocking the connection of the pressurizing volume of the fluid supply to atmosphere, connecting the pressurizing system to the pressurizing volume of the fluid supply, and generating air pressure in the pressurizing system to expel fluid from the fluid bag over the fluid delivering tube to the printhead, wherein pressure is applied to the fluid in the fluid bag by generating and feeding air at a given pressure from the pressurizing system to the pressurizing volume of the fluid supply, wherein the output signal of the second sensor is used to determine a remaining amount of fluid in the fluid bag of the fluid supply.

7. The method of claim 1, wherein the fluid contained in the fluid bag is printer ink.

8. A fluid supply for use in the method of claim 1, wherein the fluid supply comprises a cartridge including a fluid bag and a closed pressurizing volume which surrounds the fluid bag, wherein the cartridge has a first connecting element to connect the pressurizing volume of the fluid supply to a pressurizing system, and a second connecting element to connect the interior of the fluid bag to a fluid delivering tube connected to a printhead, and wherein the cartridge further includes a blocking element which blocks the pressurizing volume of the fluid supply from the pressurizing system, and a vent which provides a connection of the pressurizing volume to atmosphere.

9. The fluid supply of claim 8, wherein the fluid bag contains a fluid to be delivered to the fluid delivering tube connected to the printhead, and wherein the pressurizing volume expels fluid from the fluid bag to the fluid delivering tube when pressure is applied from the pressurizing system to the pressurizing volume.

10. A fluid supply for use in the method of claim 1, wherein the fluid supply comprises a cartridge including a fluid bag which contains a fluid to be delivered to a fluid delivering tube connected to a printhead, and a closed pressurizing volume which surrounds the fluid bag to expel fluid from the fluid bag to the fluid delivering tube when applying pressure from a pressurizing system to the pressurizing volume, wherein the cartridge has a first connecting element to connect the pressurizing volume of the fluid supply to the pressurizing system, and a second connecting element to connect the interior of the fluid bag to the fluid delivering tube, and wherein the cartridge further includes a blocking valve which is operable to disconnect the pressurizing volume of the fluid supply from the pressurizing system, and a venting valve which is operable to provide a connection of the pressurizing volume to atmosphere.

11. The fluid supply of claim 9, wherein the fluid contained in the fluid bag is printer ink.

12. The fluid supply of claim 10, wherein the fluid contained in the fluid bag is printer ink.

13. A fluid delivering system in a printer, wherein the fluid delivering system comprises a fluid supply with a cartridge including a fluid bag and a closed pressurizing volume which surrounds the fluid bag, wherein the cartridge has a first connecting element to connect the pressurizing volume of the fluid supply to a pressurizing system, and a second connecting element to connect the interior of the fluid bag to a fluid delivering tube connected to a printhead, wherein the fluid delivering system further comprises a first sensor to measure pressure in the pressurizing system relative to atmosphere, and a second sensor to provide an output signal which indicates a pressure difference between the pressurizing system and the fluid delivering tube, wherein the cartridge further includes a blocking element which blocks the pressurizing volume of the fluid supply from the pressurizing system, and a vent which provides a connection of the pressurizing volume to atmosphere, and wherein the fluid delivering system further comprises a controller which is operable to generate pressure in the pressurizing system, to perform measurements of the pressure in the pressurizing system by the first sensor, and to calibrate the second sensor by the measurements of the first sensor.

14. The fluid delivering system of claim 13, wherein the blocking element is a blocking valve which is operable to connect and to disconnect the pressurizing volume of the fluid supply from the pressurizing system, and wherein the vent includes a venting valve which is operable to provide and to close a connection of the pressurizing volume to atmosphere.

15. The fluid delivering system of claim 13, wherein the fluid contained in the fluid bag is printer ink.

* * * * *